US010302359B2

(12) United States Patent
Meier

(10) Patent No.: US 10,302,359 B2
(45) Date of Patent: May 28, 2019

(54) COLUMN NARROWING DIVIDER FOR A GRAIN DRYER

(71) Applicant: Sukup Manufacturing Co., Sheffield, IA (US)

(72) Inventor: Mitchell Chase Meier, Mason City, IA (US)

(73) Assignee: Sukup Manufacturing Co., Sheffield, IA (US)

( * ) Notice: Subject to any disclaimer, the term of this patent is extended or adjusted under 35 U.S.C. 154(b) by 330 days.

(21) Appl. No.: 14/310,366

(22) Filed: Jun. 20, 2014

(65) Prior Publication Data

US 2015/0369537 A1 Dec. 24, 2015

(51) Int. Cl.
*F26B 17/12* (2006.01)
*F26B 3/14* (2006.01)

(52) U.S. Cl.
CPC ..... *F26B 17/122* (2013.01); *F26B 3/14* (2013.01); *F26B 17/126* (2013.01); *F26B 2200/06* (2013.01)

(58) Field of Classification Search
CPC .. F26B 17/122; F26B 17/126; F26B 2200/06; F26B 17/124
USPC ..... 34/165, 168, 174, 231
See application file for complete search history.

(56) References Cited

U.S. PATENT DOCUMENTS

| | | | | |
|---|---|---|---|---|
| 2,245,664 A * | 6/1941 | Gronert | F26B 17/122 34/174 |
| 3,237,315 A * | 3/1966 | Benecke | F26B 19/005 222/200 |
| 4,398,356 A * | 8/1983 | Westelaken | F26B 17/122 34/102 |
| 4,404,756 A * | 9/1983 | Noyes | F26B 17/122 34/169 |
| 2006/0123655 A1 | 6/2006 | Valfiorani | |
| 2013/0014404 A1 * | 1/2013 | Bloemendaal | F26B 17/126 34/167 |

FOREIGN PATENT DOCUMENTS

| | | | |
|---|---|---|---|
| GB | 529901 A * | 11/1940 | F26B 17/124 |

OTHER PUBLICATIONS

Sukup Manufacturing Co.; Sukup Grain Dryers; May 2013; pp. 1-3; Sukup Manufacturing Co.; U.S.A.

* cited by examiner

*Primary Examiner* — Jessica Yuen
(74) *Attorney, Agent, or Firm* — Zarley Law Firm, P.L.C.

(57) ABSTRACT

A grain dryer having a column with an interior wall, an exterior wall, an inlet and an outlet. The column has an upper heated pressurized plenum and a lower, low pressure, suction plenum. Attached to the interior wall within the column is a narrowing divider that increases the path of the heated air at the pressure gradient.

8 Claims, 3 Drawing Sheets

COLUMN NARROWING DIVIDER FOR A GRAIN DRYER

BACKGROUND OF THE INVENTION

This invention is directed to a narrowing column divider and more particularly to a column narrowing divider for a continuous-flow grain dryer.

Continuous-flow grain dryers are well-known in the art for dryers 10 having a column 12 with a split plenum, as shown in FIG. 1, a lower suction plenum 24 pulls a portion of the upper heated air P from an upper heated pressurized plenum 22 which reduces the capacity and the amount of cooling of the dryer. Presently, in current dryers, there is no restriction to the pressure gradient within the grain column to reduce the waste of heated air. Therefore, a need exists in the art for a device that addresses these deficiencies.

An objective of the present invention is to provide a grain dryer that improves the efficiency of drying grain.

Another objective of the present invention is to provide a grain dryer that restricts airflow from wrapping around the plenum divider 25 within a column from a high pressure to a low pressure plenum.

A still further objective of the present invention is to provide a grain dryer that better utilizes heated air.

These and other objectives will be apparent to those of ordinary skill in the art based upon the following written description, drawings, and claims.

SUMMARY OF THE INVENTION

A grain dryer having a column with an interior wall, an exterior wall, an inlet and an outlet. The column has an upper heated pressurized plenum and a lower, low pressure, suction plenum. Attached to the interior wall within the column is a narrowing divider that increases the path of the heated air at the pressure gradient.

DETAILED DESCRIPTION OF THE PREFERRED EMBODIMENT

Figure 1:
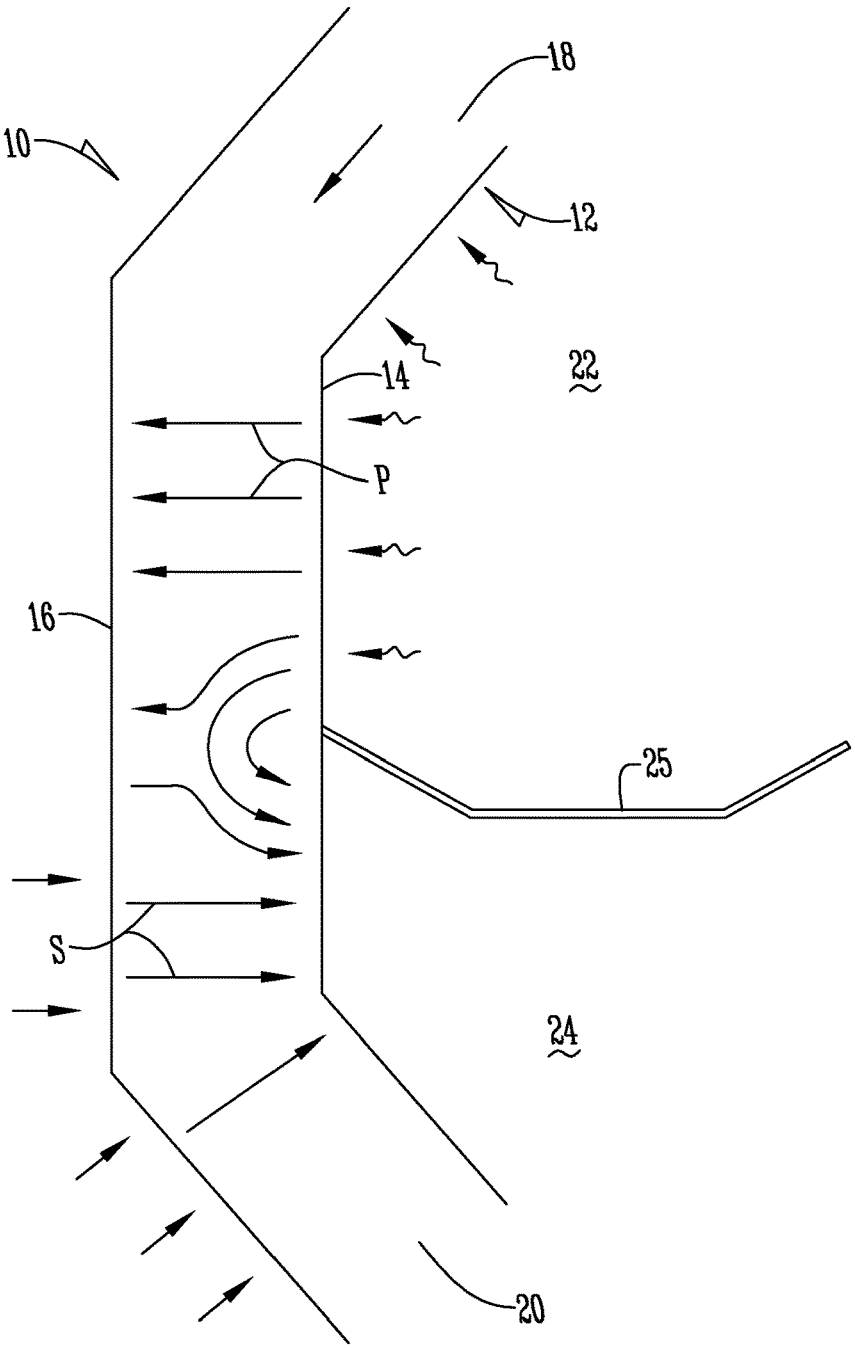
Fig. 1 (Prior Art)
FIG. 1 is a side sectional view of a prior art grain dryer column.
Figure 2:
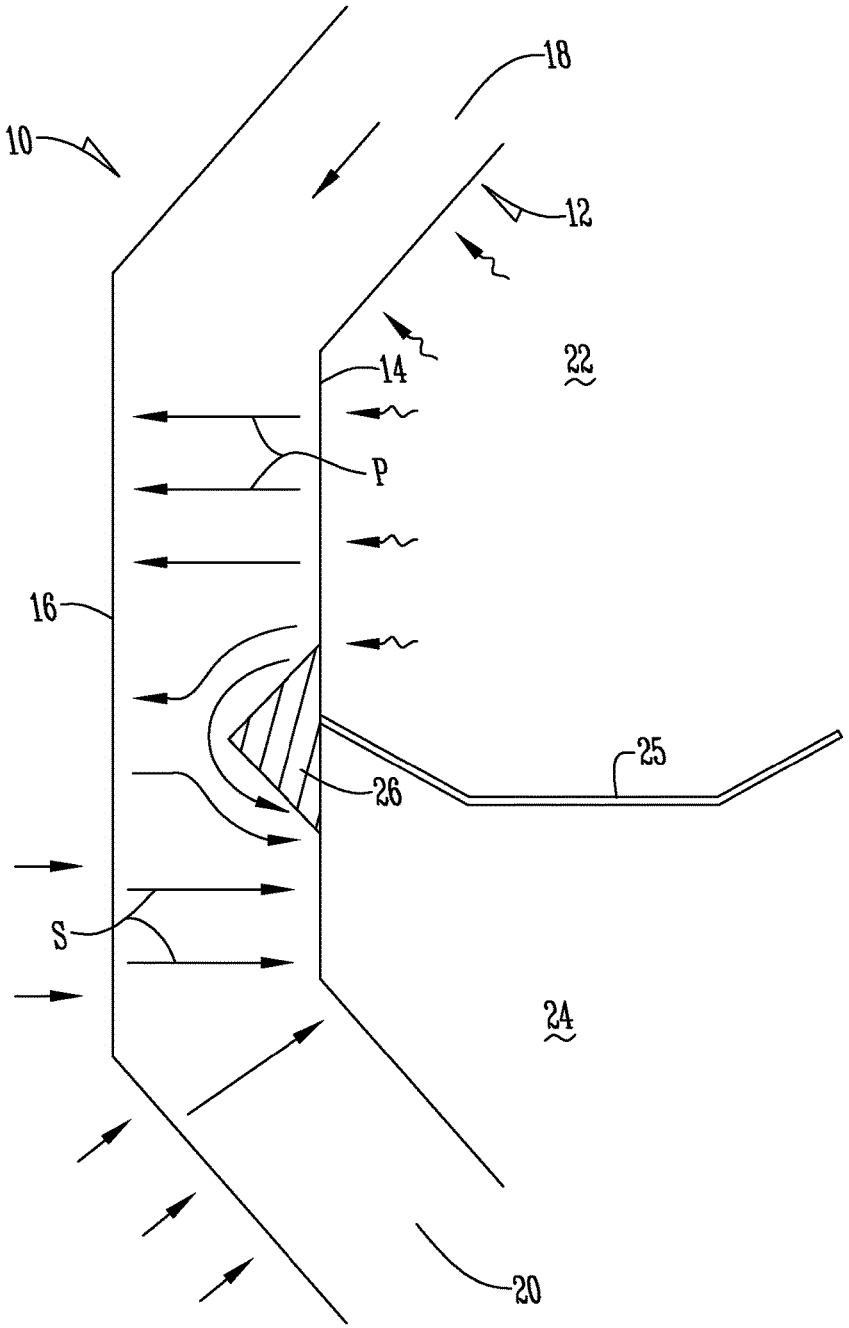
FIG. 2 is a side sectional view of a grain dryer column.
Figure 3:
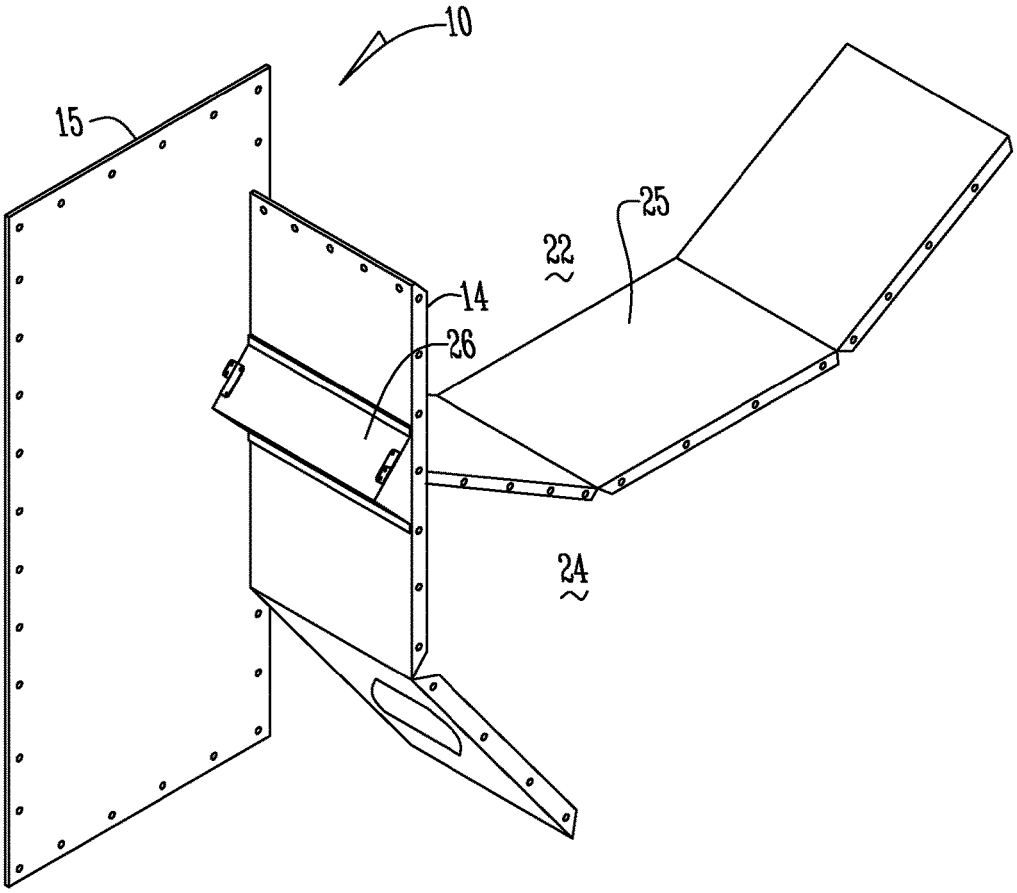
FIG. 3 is a partial perspective view of a grain dryer column.

Referring to the Figures, a continuous-flow grain dryer 10 has a plurality of columns 12 having an interior wall 14, sidewalls 15 and an exterior wall 16. Grain is received in an inlet 18 of column 12 and flows downwardly to an outlet 20.

The dryer 10 has an upper or heated pressurized plenum 22 for drying the grain and a lower or suction plenum 24 for cooling the grain separated by a plenum divider 25. Positioned within the column 12 is a narrowing divider 26. The narrowing divider 26 is of any structure and shape and preferably has a triangular profile. The divider 26 is attached to the interior wall 14 and the sidewalls 15 between the pressure 22 and suction 24 plenums and extends partially within the column. In one embodiment, the narrowing divider 26 is laser cut from steel and then bent to a specific angle to facilitate grain movement. The angle may change depending on the type of grain.

In operation, grain is received through the inlet 18 and flows through column 12 to outlet 20. As air flows, as shown by arrows P, heated pressurized air flows out of the pressure plenum 22 through interior wall 14 toward the exterior wall 16 where most of the heated air exits.

Simultaneously, cool ambient air, as shown by arrows S, flows into the suction plenum 24 through exterior wall 16 toward the interior wall 14 through a suction or vacuum force.

The narrowing divider 26 reduces the pressure gradient experienced by the air within the vertical grain column 12 between plenum 22 and plenum 24. The amount of air that experiences the pressure gradient is reduced which improves heated exhaust airflow and cooling airflow intake. The narrowing divider 26 increases the length of the path that the heated air P must take to get to the suction plenum 24 which results in more heated air exiting from the pressure plenum 22 through grain column 12 and directly through outer wall 16 increasing drying capacity and cooling. Less hot air also will return to the fan (not shown) for recycling which improves the cooling capacity of the dryer and reduces the relative humidity of the working heated air.

Thus a column narrowing divider for a continuous-flow dryer has been disclosed that at the very least meet all the stated objectives.

I claim:

1. A continuous-flow grain dryer, comprising;

a column having an interior wall, an exterior wall, an inlet, and an outlet;

a heated pressurized plenum and a suction plenum in communication with the column;

a plenum divider separating the heated pressurized plenum and the suction plenum;

a narrowing divider having a triangular profile having a first end and a second end attached to the interior wall at the column, wherein the narrowing divider extends outwardly from the first end to a point and extends inwardly from the point to the second end such that the narrowing divider partially extends within the column between the pressure and suction plenums; and wherein the narrowing divider is positioned between the heated pressurized plenum and the suction plenum, such that the narrowing divider reduces an amount of air that experiences pressure gradient.

2. The dryer of claim 1 wherein the heated pressurized plenum is configured to allow heated pressurized air to flow out through the interior wall towards the exterior wall.

3. The dryer of claim 1 wherein the suction pressurized plenum is configured to allow cool air to flow out through the exterior wall towards the interior wall.

4. The dryer of claim 1 wherein the narrowing divider is configured to increase the amount of heated air exiting directly through the exterior wall.

5. The dryer of claim 1 wherein when heated pressurized air flows out of the heated pressurized plenum, cool ambient air flows into the suction plenum.

6. The dryer of claim 5 wherein the cool ambient air flows through a suction force.

7. A continuous-flow grain dryer, comprising;

a column having an interior wall, an exterior wall, an inlet, and an outlet;

the column in communication with a heated pressurized plenum and a suction plenum;

a narrowing divider having a first end and a second end attached to the interior wall, wherein the narrowing divider extends outwardly from the first end to a point and extends inwardly from the point to the second end such that the narrowing divider partially extends within the column between the pressurized plenum and the suction plenum.

8. A continuous-flow grain dryer, comprising;

a column having an interior wall, an exterior wall, an inlet, and an outlet;

the column in communication with a heated pressurized plenum configured to allow heated pressurized air to flow out through the interior wall towards the exterior wall, and a suction plenum configured to allow cool air to flow out through the exterior wall towards the interior wall;

a narrowing divider extending within the column between the pressurized plenum and suction plenum, wherein the narrowing divider extends outwardly from a first end attached to the interior wall to a point and inwardly from the point to a second end attached to the interior wall; and wherein the narrowing divider is positioned such that the narrowing divider reduces an amount of air that experiences pressure gradient.

* * * * *